US006386948B1

(12) United States Patent
Kondo

(10) Patent No.: US 6,386,948 B1
(45) Date of Patent: May 14, 2002

(54) MAGNET MEMBER CUTTING METHOD AND MAGNET MEMBER CUTTING

(75) Inventor: Sadahiko Kondo, Takarazuka (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 20 days.

(21) Appl. No.: 09/583,559

(22) Filed: May 31, 2000

(30) Foreign Application Priority Data

Jun. 1, 1999 (JP) ..... 11-154114

(51) Int. Cl.[7] ..... B24B 1/00
(52) U.S. Cl. ..... 451/28; 451/53
(58) Field of Search ..... 451/28, 41, 53, 451/57, 177, 178, 182; 125/13.01, 12, 20

(56) References Cited

U.S. PATENT DOCUMENTS

| | | | | | |
|---|---|---|---|---|---|
| 4,016,855 | A | * | 4/1977 | Minata | 451/53 |
| 5,203,122 | A | * | 4/1993 | Campbell | 451/53 |
| 5,981,448 | A | * | 11/1999 | Matsui et al. | 508/101 |
| 6,012,977 | A | * | 1/2000 | Yoshikawa et al. | 451/541 |
| 6,071,047 | A | * | 6/2000 | Nakai | 451/449 |
| 6,123,606 | A | * | 9/2000 | Hill et al. | 451/449 |

FOREIGN PATENT DOCUMENTS

| | | | |
|---|---|---|---|
| JP | 7-148641 | | 6/1995 |
| JP | 8-25125 | | 3/1996 |
| JP | 10-180750 | | 7/1998 |
| JP | 11-19862 | | 1/1999 |
| JP | 11-309674 | | 11/1999 |
| JP | 2001-47363 | * | 2/2001 |

* cited by examiner

*Primary Examiner*—Derris H. Banks
(74) *Attorney, Agent, or Firm*—Armstrong, Westerman & Hattori, LLP

(57) ABSTRACT

A magnet member cutting apparatus comprises a temperature controller for temperature control of a coolant. The coolant at a temperature controlled by the temperature controller is supplied to a cutting region from a coolant discharging device via a coolant supplying path. While the coolant is supplied to the cutting region, a magnet member which is a sintered rare-earth magnet member is cut by a cutting blade having a cutting edge including a mixture of abrasive grain made of a super hard abrasive grain and heat resistant resin made of a phenol resin. Preferably, the coolant is used in circulation, the coolant temperature is maintained at 20° C.~35° C., the cutting blade rotating speed is 1000 m/min~3000 m/min, a volume rate of the abrasive grain to the cutting edge is 10%~50%, and the cutting edge further includes metal powder.

20 Claims, 10 Drawing Sheets

FIG. 7

<Result after 100 Passes>

| Coolant | Cold | Normal | Hot |
|---|---|---|---|
| Coolant Temperature (°C) | 12 | 25 | 45 |
| Cutting Resistance : Fz<br>(kgf/3-blade block)<br>(kN/3-blade block) | <br>43.20<br>0.42 | <br>31.20<br>0.31 | <br>18.00<br>0.18 |
| Cutting Resistance : Fx<br>(kgf/3-blade block)<br>(kN/3-blade block) | <br>22.4<br>0.22 | <br>13.6<br>0.13 | <br>13.0<br>0.13 |
| Main Shaft Load Current (A) | 13.5 | 10.0 | 10.0 |
| Cutting Blade Wear<br>(Cutting Edge Wear) (mm) | 0.14 | 0.41 | 1.20 |
| Cutting Blade Bend (mm) | 0.196 | 0.088 | 0.070 |
| Cutting Ratio<br>(Volume of Cut/Volume of Wear) | 6445 | 2375 | 1100 |

Volume removed by machining : 96000 $mm^3$/100 passes

MAGNET MEMBER CUTTING METHOD AND MAGNET MEMBER CUTTING

BACKGROUND OF THE INVENTION

1. Field of the Invention

The present invention relates to a magnet member cutting method and a magnet member cutting apparatus, and more specifically to a magnet member cutting method and a magnet member cutting apparatus for cutting a magnet member by using a cutting blade having a cutting edge including abrasive grain and heat resistant resin for example.

2. Description of the Related Art

A conventional magnet member cutting apparatus uses a cutting blade comprising a base plate having an outer circumferential edge bonded with a mixture of diamond abrasive grain and resin. The resin plays an important part in cutting performance of the cutting blade.

Specifically, when cutting, if the resin is worn too soon, then the diamond abrasive grain is exposed one after another to a surface of the cutting edge, making a smooth cut surface of the magnet member, but the quick wear of the cutting blade makes a life of the cutting blade very short, leading to high cost.

On the other hand, when cutting, if the resin is worn too slowly, then the diamond abrasive grain is not exposed easily to the surface of the cutting edge, making the life of the cutting blade long but the quality of the cut surface is decreased. This problem becomes particularly significant when cutting a hard and brittle member such as a rare-earth magnet comprising a primary phase and a grain boundary phase. Further, because the rare-earth magnet is more expensive than a ferrite magnet, for the sake of cutting yield, a thin cutting blade having a blade thickness of 0.6 mm~1.0 mm and an outer diameter of 125 mm for example, is used. Therefore, if cutting ability of the cutting blade decreases, the quality of cut surface decreases drastically.

Further, there is inconsistency in the life of the cutting blade and quality of a cut surface; for example, the life of the cutting blade becomes shorter in a certain period of year, or the quality of the cut surface decreased in a certain time period of day.

SUMMARY OF THE INVENTION

It is therefore a primary object of the present invention to provide a magnet member cutting method and a magnet member cutting apparatus capable of increasing the life of the cutting blade life while improving the quality of the cut surface.

According to an aspect of the present invention, there is provided a magnet member cutting method comprising: a first step of preparing a cutting blade having a cutting edge including abrasive grain and heat resistant resin; and a second step of cutting a magnet member by the cutting blade while supplying temperature-controlled coolant to a cutting region.

According to another aspect of the present invention, there is provided a magnet member cutting apparatus comprising: temperature controlling means for temperature control of a coolant; coolant supplying means for supply of the coolant at a temperature controlled by the temperature controlling means to a cutting region; and cutting operation means for cutting the magnet member by using the cutting blade having a cutting edge including abrasive grain and heat resistant resin while the coolant is supplied by the coolant supplying means to the cutting region.

According to still another aspect of the present invention, there is provided a magnet member cutting apparatus comprising: temperature controller for temperature control of a coolant; coolant supplying path for the coolant at a temperature controlled by the temperature controller; a coolant discharging device for supply of the coolant from the coolant supplying path to a cutting region; and cutting operation portion for cutting the magnet member by using the cutting blade having a cutting edge including abrasive grain and heat resistant resin while the coolant is supplied by the coolant discharging device to the cutting region.

According to still another aspect of the present invention, there is provided a rare-earth magnet obtained by a magnet member cutting method comprising: a first step of preparing a cutting blade having a cutting edge including abrasive grain and heat resistant resin; and a second step of cutting a magnet member by the cutting blade while supplying temperature-controlled coolant to a cutting region.

According to the present invention, the magnet member is cut by the cutting blade while supplying the cutting region with the coolant at a temperature controlled in accordance with the heat resistant resin. By controlling the temperature of the coolant, the amount of wear of the heat resistant resin at the time of cutting can be controlled. Therefore, if the temperature of the coolant is controlled appropriately, the heat resistant resin wears appropriately at the time of cutting, letting the worn abrasive grain fall off to allow new abrasive grain to be exposed to the surface, thereby continuously maintaining the state in which the abrasive grain is exposed. As a result, the life of the cutting blade can be increased, the quality of the cut surface is improved, and production efficiency can be improved. The present invention is especially effective when obtaining a rare-earth magnet.

Preferably, the coolant is used in circulation. In this case, an amount of coolant consumption can be decreased, making possible to save the coolant. When the coolant is used in circulation, heat accumulation in the coolant usually becomes intense; however, according to the present invention, by controlling the temperature of the coolant, the coolant of a desired temperature can be supplied to the cutting region. As described above, the present invention offers significant effect when the coolant is used in circulation.

Further, preferably, the abrasive grain used in the cutting blade is a super hard abrasive grain such as diamond abrasive grain. In this case, chipping of the cutting edge is reduced at the time of cutting, and when the exposed abrasive grain has been worn, new abrasive grain from beneath has already exposed, leading to improvement in the quality of the cut surface.

Further, preferably, the heat resistant resin used in the cutting blade is a phenol resin. In this case, heat at the time of cutting makes the phenol resin be worn appropriately at the cutting region, facilitating the exposure of the new abrasive grain, leading to improvement in the quality of the cut surface.

Preferably, the temperature of the coolant is 20° C.~35° C. If the temperature of the coolant supplied to the cutting region is lower than 20° C., the phenol resin remains hard and therefore not easily be worn, preventing the new abrasive grain from appropriate exposure and reducing the cutting ability. Thus, the cutting is continued with a dull cutting edge, reducing the cutting accuracy. On the other hand, if the temperature of the coolant exceeds 35° C., the phenol resin becomes too soft. Therefore, although the new abrasive grain is exposed, the phenol resin is worn too quickly to support the abrasive grain, resulting in premature falling of the abrasive grain and early wear of the cutting edge, which is economically not preferable. Further, the cutting blade must be replaced more often, resulting in decrease in operating efficiency. As a result, the temperature of the coolant should be desirably 20° C.~35° C., at which the magnet member can be cut appropriately, with improved quality of the cut surface.

Further, preferably, the rotating speed of the cutting blade is 1000 m/min~3000 m/min. If the rotating speed of the cutting blade is slower than 1000 m/min, the cutting time becomes too long, and the cutting blade is deformed by idle rotation. On the other hand, if the rotating speed of the cutting blade exceeds 3000 m/min, an air flow accompanying the rotation prevents sufficient supply of the coolant to the cutting region, causing seizure of the cutting blade.

Further, preferably, a volume rate of the abrasive grain to the cutting edge is 10%~50%. If the volume rate of the abrasive grain is lower than 10%, the amount of the abrasive grain is too small and the cutting ability becomes extremely low. On the other hand, if the volume rate of the abrasive grain exceeds 50%, the amount of the abrasive grain is too much, resulting in decreased binding by the resin and therefore excessive fall of the abrasive grain, which reduces the life of the cutting blade.

Preferably, the cutting edge further includes metal powder. In this case, heat resistance and strength of the cutting blade can be increased.

The present invention is suitable to the cutting of a sintered rare-earth magnet member. When the sintered rare-earth magnet member is cut, cutting load is large, but by controlling the temperature of the coolant, the cutting load can be decreased, and the quality of the cut surface can be improved.

The above objects, other objects, characteristics, aspects and advantages of the present invention will become clearer from the following description of embodiments to be presented with reference to the accompanying drawings.

BRIEF DESCRIPTION OF THE DRAWINGS

FIG. 7 is a table showing a result of experiment according to the present invention;

DETAILED DESCRIPTION OF THE PREFERRED EMBODIMENTS

Hereinafter, an embodiment of the present invention will be described with reference to the attached drawings.

Figure 1:
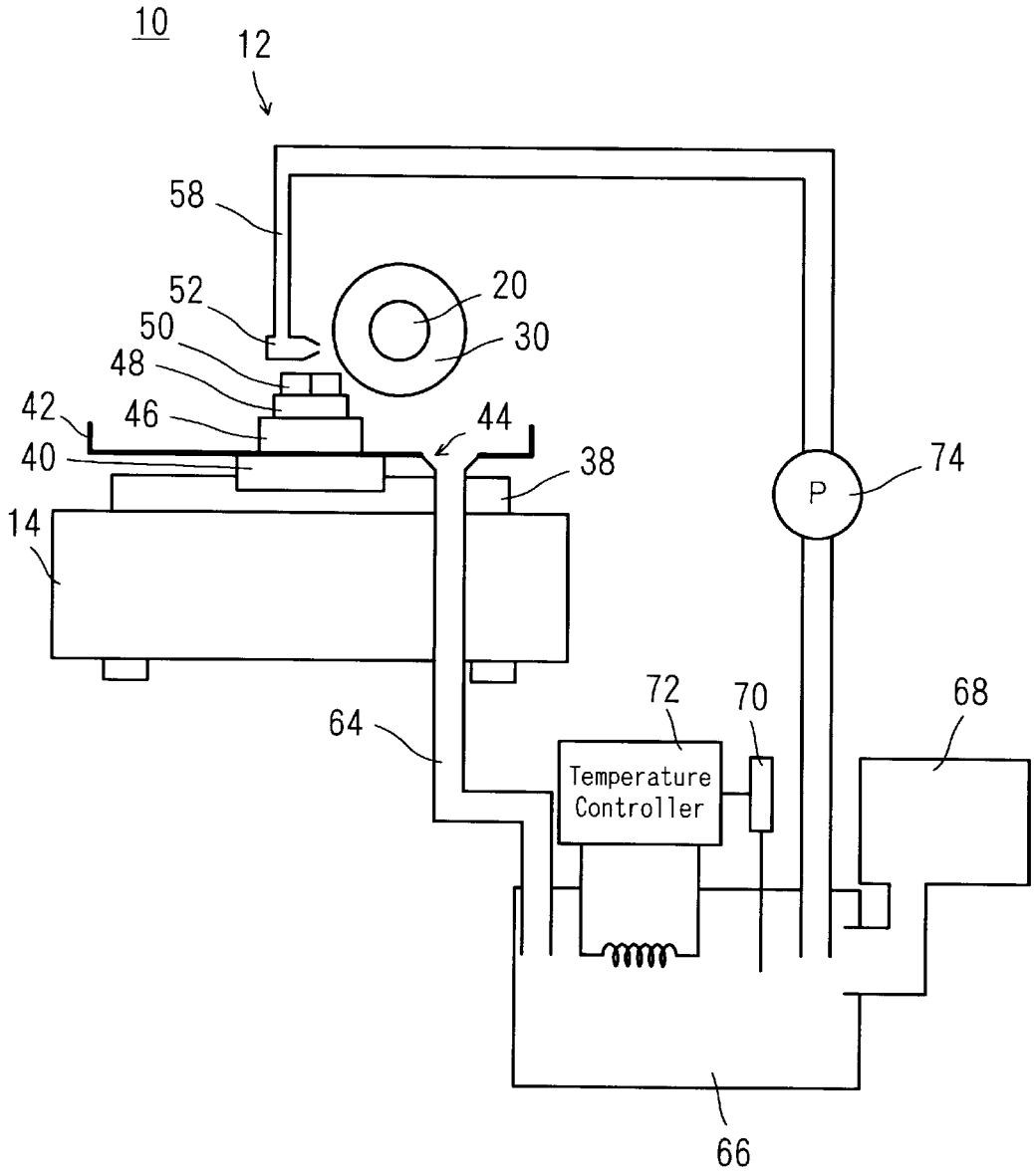
FIG. 1 is a conceptual diagram showing an embodiment of the present invention.
Figure 2:
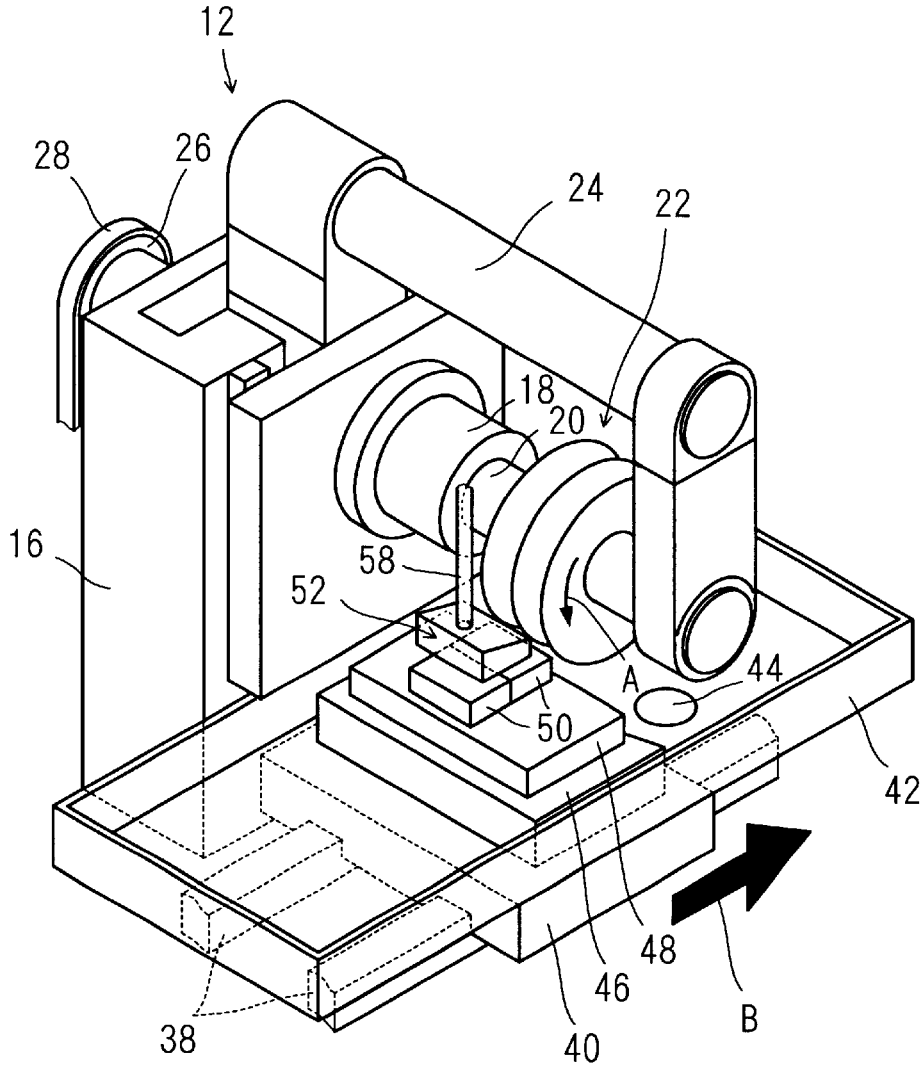
FIG. 2 is a perspective view showing a cutting operation portion of the embodiment in FIG. 1.

Referring to FIG. 1 and FIG. 2, a magnet member cutting apparatus 10 as an embodiment of the present invention is an over-hang X-feeding cutting apparatus as a so-called cantilever type cutting apparatus, and comprises a cutting operation portion 12 for cutting a magnet member 50 (to be described later).

The cutting operation portion 12 includes a base 14. The base 14 has an upper surface disposed with a column 16 as shown in FIG. 2. The column 16 has a side surface provided with a supporting portion 18. The supporting portion 18 rotatably supports a rotating shaft 20.

The rotating shaft 20 is mounted with a cutting blade block 22. The rotating shaft 20 has an end supported by a support arm 24, and another end mounted with a pulley 26. The pulley 26 is provided with a belt 28. By driving the belt 28 using a rotating shaft driving motor (not illustrated), the rotating shaft 20 and the cutting blade block 22 are rotated in a direction indicated by an arrow A for example.

Figure 3A:
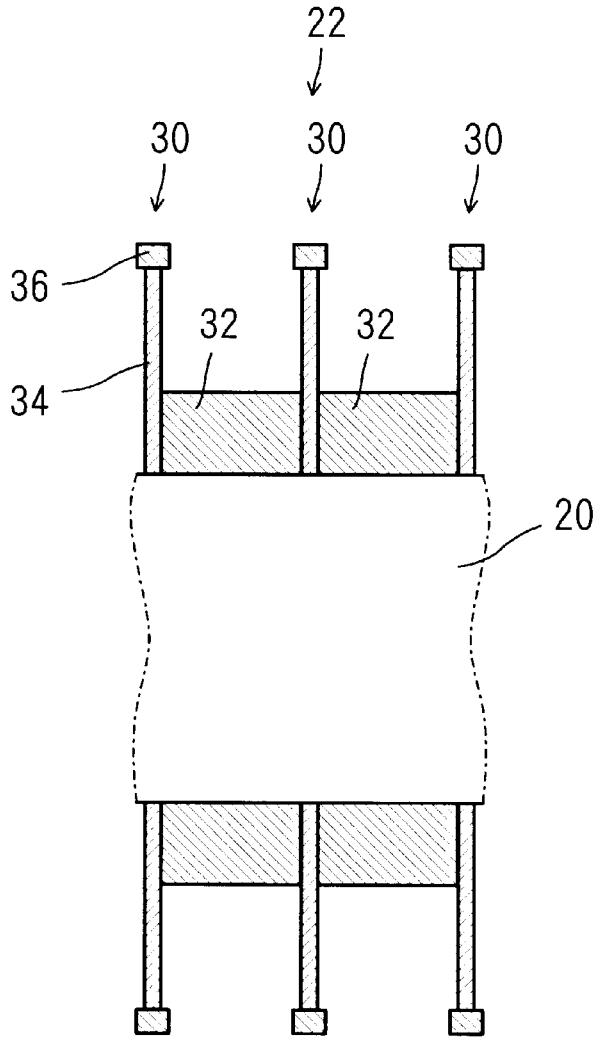
FIG. 3A is a conceptual diagram showing a section of a cutting blade block.

Referring to FIG. 3A, the cutting blade block 22 includes a plurality (specifically three, according to the present embodiment) of cutting blades 30. Each of the cutting blades 30 is spaced from an adjacent one of the others by an annular spacer 32. Each of the cutting blades 30 includes a base plate 34 like a doughnut shaped disc. The base plate 34 has an outer circumferential edge provided with a cutting edge 36 made of a super hard abrasive grain.

The base plate 34 is made for example of a hard alloy such as tungsten carbide or a high speed steel. Alternatively, the base plate 34 may be made of a sintered diamond alloy which is an alloy made by sintering diamond, cBN (cubic-system boron nitride) or the like with a hard alloy, disclosed in the Japanese Patent Laid-Open Nos. 8-109431 and 8-109432.

Figure 3B:
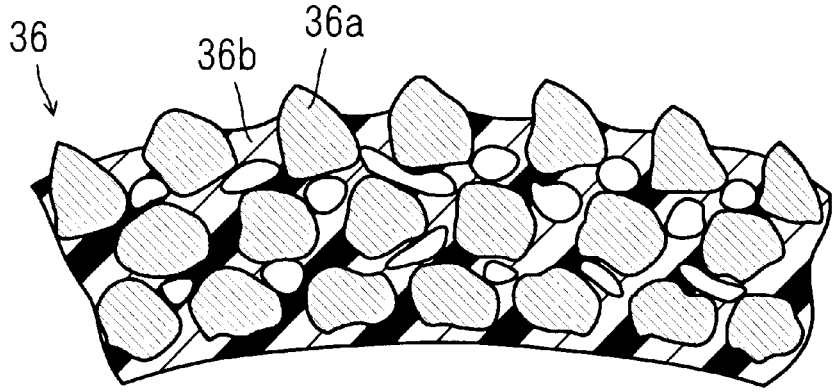
FIG. 3B is a conceptual diagram showing a partial section of a cutting edge.

Further, as shown in FIG. 3B, the cutting edge 36 is made of a mixture of an abrasive grain 36a and a heat resistant resin 36*b*. Specifically, the abrasive grain 36*a* is bonded by the heat resistant resin 36*b* to the base plate 34.

The abrasive grain 36*a* is made of a super hard abrasive grain for example. The super hard abrasive grain may be such substance as natural or synthetic diamond powder, cBN powder, and a mixture of the natural or synthetic diamond powder and cBN powder. The abrasive grain 36*a* has a grain diameter of about 160 $\mu$m~250 $\mu$m for example.

The heat resistant resin 36*b* is made of a thermosetting resin for example. The thermosetting resin may be a phenol resin or a polyimide resin for example. If the heat resistant resin 36*b* is a phenol resin and the abrasive grain 36*a* is a synthetic diamond powder for example, then the cutting edge 36 is a resin-diamond grinding stone.

Returning to FIG. 2, the base 14 has an upper surface provided with a pair of rails 38, in which an X-slider 40 is slidably mounted. The X-slider 40 has an upper surface disposed with pan 42. The pan 42 has a bottom surface provided with a draining port 44 for draining a coolant 54 (to be described later). The pan 42 has a side surface provided with upright plates (not illustrated) preventing the coolant 54 from splashing out. Further, the bottom surface of the pan 42 is disposed with a chuck table 46 having an upper surface provided with a pasting plate 48. The pasting plate 48 has an upper surface on which a plurality, for example, of magnet members 50 are fixed by adhesive. The magnet member 50 is a sintered rare-earth magnet member used for driving an optical pickup lens, for example.

Figure 4:
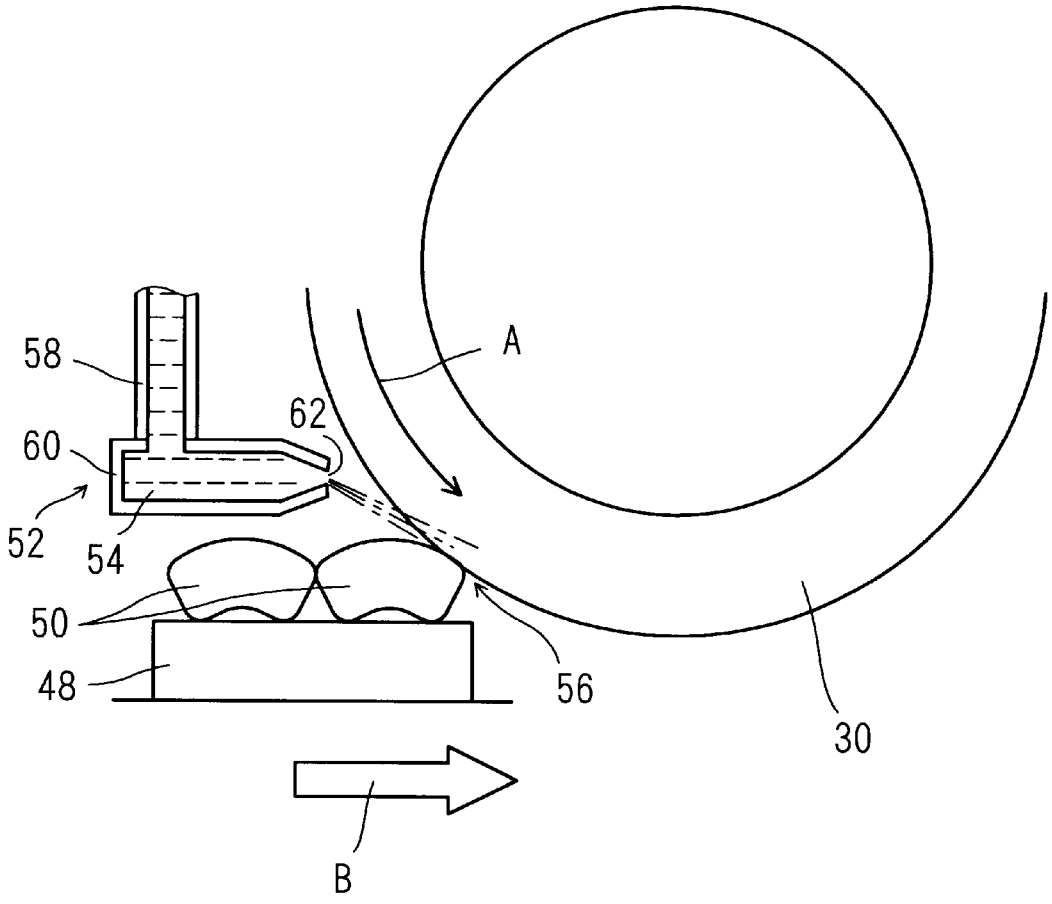
FIG. 4 is a diagram showing a coolant discharging device disposed near the cutting blade.

With the above arrangement, by sliding the X-slider 40 in a direction indicated by an arrow B (along the X axis), thereby relatively moving the magnet members 50 at a constant speed toward the cutting blade block 22 rotating in the direction indicated by the arrow A, the magnet members 50 can be cut into a predetermined dimension. When cutting the magnet members 50, as shown also in FIG. 4, the coolant 54 is supplied to a cutting region 56 from a coolant discharging device 52 disposed near the cutting blades 30.

The coolant 54 is primarily made of water. The coolant 54 has a surface tension of 25 dyn/cm~60 dyn/cm, and is discharged at a pressure of 2 kgf/cm$^2$~15 kgf/cm$^2$. If the primary ingredient is water, cooling capability is high because of a high specific heat. If the surface tension is 25 dyn/cm~60 dyn/cm, the coolant 54 has a good permeability to the cutting edge 36, improving cutting efficiency. Further, if the discharge pressure is 2 kgf/cm$^2$~15 kgf/cm$^2$, it is possible to supply the coolant 54 to a place of cutting of the magnet members 50 even if there is an accompanying air flow generated by the rotation of the cutting blades 30. Still further, if the discharge pressure is within the range of 2 kgf/cm$^2$~15 kgf/cm$^2$, the cutting blades 30 are not deformed by the discharge pressure, improving dimensional accuracy of products. The discharge pressure is more preferably between 3 kgf/cm$^2$ and 7 kgf/cm$^2$, which makes possible to further improve the dimensional accuracy and production efficiency.

It should be noted here that a antifoaming agent may be added by the coolant 54 so that rapid temperature increase caused by foaming can be prevented at the cutting region 56. The additives for the coolant 54 may include a surfactant or synthetic type lubricant, a rust inhibitor, a non-ferrous metal anticorrosive, an antiseptic and an antifoaming agent.

The surfactant added to the coolant 54 including water as a primary ingredient can be an anionic surfactant or a nonionic surfactant. Examples of the anionic surfactant are a fatty acid derivative such as fatty acid soap and naphthenic acid soap; a sulfate ester surfactant such as long-chain alcohol sulfate ester and sulfated oil of animal or vegetable oil; and a sulfonic acid surfactant such as petroleum sulfonate. Examples of the nonionic surfactant are a polyoxyethylene surfactant such as polyoxyethylene alkylphenyl ether and polyoxyethylene monofatty acid ester; a polyhydric alcohol surfactant such as sorbitan monofatty acid ester; and an alkylol amide surfactant such as fatty acid diethanol amide. Specifically, the surface tension and the coefficient of dynamic friction can be adjusted within the preferred ranges by adding to water approximately 2 wt % of a chemical solution type surfactant, JP-0497N (manufactured by Castrol Limited).

The synthetic type lubricant can be any of a synthetic solution type lubricant, a synthetic emulsion type lubricant and a synthetic soluble type lubricant, among which the synthetic solution type lubricant is preferred. Specific examples of the synthetic solution type lubricant are Syntairo 9954 (manufactured by Castrol Limited) and #870 (manufactured by Yushiro Chemical Industry Co., Ltd.). When any of these lubricants is added to water in a concentration of approximately 2 wt %, the surface tension and the coefficient of dynamic friction can be adjusted within the preferred ranges.

Furthermore, when the coolant 54 includes a rust inhibitor, corrosion of the rare-earth alloy can be prevented. In this embodiment, pH of the coolant 54 is preferably set to 9 through 11. The rust inhibitor can be organic or inorganic. Examples of the organic rust inhibitor are carboxylate such as oleate and benzoate, and amine such as triethanol amine, and examples of the inorganic rust inhibitor are phosphate, borate, molybdate, tungstate and carbonate.

Also, an example of the non-ferrous metal anticorrosive is a nitrogen compound such as benzotriazole, and an example of the antiseptic is a formaldehyde donor such as hexahydrotriazine.

Furthermore, silicone emulsion can be used as the antifoaming agent. When the coolant 54 includes an antifoaming agent, the coolant 54 can be prevented from foaming up so as to attain high permeability. As a result, the cooling effect can be enhanced, and the temperature increase at the cutting edge 36 can be avoided. Thus, the abnormal temperature increase and the abnormal abrasion of the cutting edge 36 of the cutting blade 30 can be suppressed.

The coolant discharging device 52 includes a stagnation portion 60 connected to a coolant supplying path 58. The stagnation portion 60 stores the coolant 54 coming from the coolant supplying path 58. The coolant 54 is discharged to the cutting region 56 from a discharging port 62 formed at a tip of the stagnation portion 60. It should be noted here that the stagnation portion 60 is variably angled according to the size of the cutting blades 30.

Returning to FIG. 1, the coolant 54 having been used at the cutting operation portion 12 gets out of the draining port 44 of the pan 42, goes through the coolant draining path 64, and then stored in a tank 66. The tank 66 is replenished with the coolant 54 from a coolant reservoir 68 as needed. Further, the tank 66 is provided with a sensor 70 for detecting a temperature of the coolant 54 in the tank 66, and a temperature controller 72 for heating/cooling the coolant 54, so that the coolant 54 is held at a predetermined temperature. The coolant 54 in the tank 66 is pumped by a pump 74 and supplied to the coolant discharging device 52 via the coolant supplying path 58. Thus, as described above, the coolant 54 is used in circulation. As the temperature controller 72, MODEL KTC-3B-LA5 manufactured by KANTO SEIKI Co., Ltd. is used.

Figure 5A:
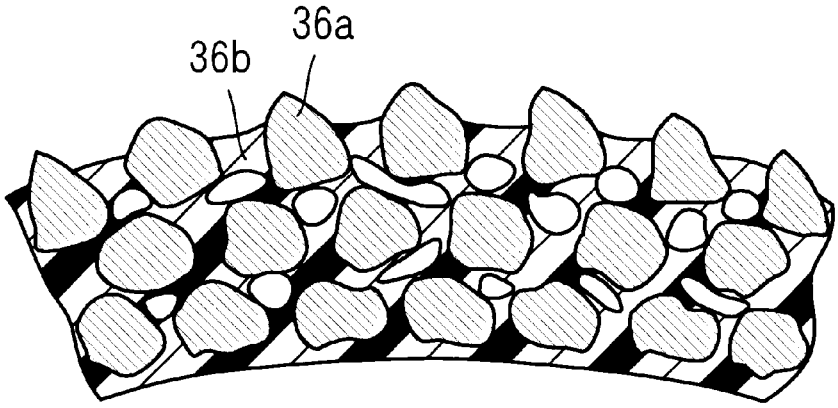
FIGS. 5A~5C are a series of conceptual diagrams illustrating state changes in the cutting edge at a time of cutting a magnet member.
Figure 5B:
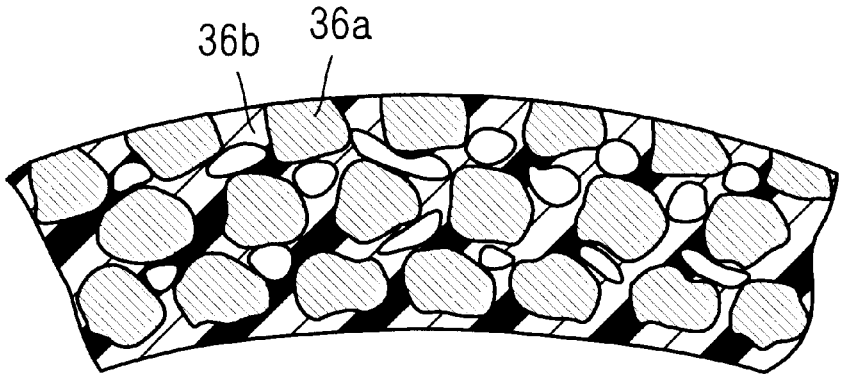
Figure 5C:
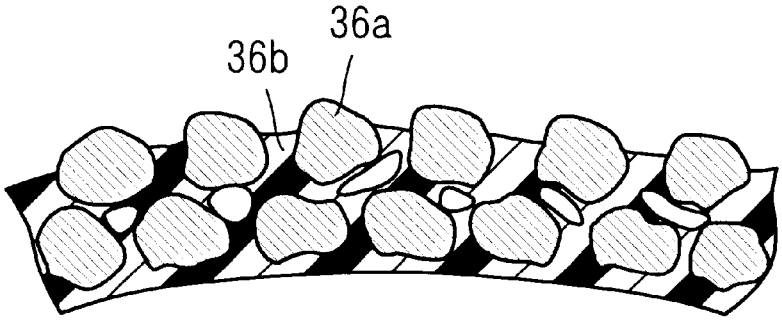

Now, state changes of the cutting edge 36 at the time of cutting the magnet member according to the magnet member cutting apparatus 10 as constituted above will be out lined with reference to FIGS. 5A~5C.

First, while the magnet member 50 is being cut by grains of the abrasive grain 36*a* exposed to a surface of the cutting edge 36 as shown in FIG. 5A, the exposed abrasive grain 36*a* is gradually worn as sown in FIG. 5B. When the abrasive grain 36*a* falls off, the heat resistant resin 36*b* in the surface is softened by friction heat and worn, and as shown in FIG. 5C, the buried abrasive grain 36*a* is exposed to the surface to cut the magnet member 50. The above cycle of the state changes of the cutting edge 36 is repeated.

According to the magnet member cutting apparatus 10, since the thermosetting resin such as a phenol resin is used as the heat resistant resin 36*b*, tensile strength of the heat resistant resin 36*b* decreases linearly with temperature increase in the cutting region 56, facilitating the exposure of the new abrasive grain 36*a* in the cutting region 56. On the other hand, if the temperature in the cutting region 56 is low, fixation by the heat resistant resin 36*b* is strong, and therefore the abrasive grain 36*a* is fixed strongly; however, since the grain exposure cycle of the abrasive grain 36*a* slows down, the magnet member 50 is not cut easily. Attention should be paid here that the temperature of the cutting region 56 is affected by the temperature of the coolant 54. Therefore, by controlling the temperature of the coolant 54 supplied to the entire cutting blade 30 including the base plate 34, the temperature of the cutting region 56 at the time of cutting is maintained within a predetermined range.

If the temperature in the cutting region 56 at the time of cutting stays within the predetermined range, the tensile strength of the heat resistant resin 36*b* is controlled at an appropriate level, allowing timely detachment and replacement of the worn abrasive grain 36*a*. Further, since the wearing speed of the heat resistant resin 36*b* becomes appropriate, timing and amount of the exposure of the abrasive grain 36*a* buried in the cutting edge 36 becomes appropriate. As a result, it becomes possible to increase life of the cutting blades 30 while maintaining sharp cutting.

Further, since the coolant 54 is used in circulation, the amount of the coolant 54 consumed can be small, making possible to save the coolant 54. It should be noted here that if the coolant 54 is used in circulation, heat accumulation in the coolant 54 usually becomes intense. However, according to the magnet member cutting apparatus 10, by controlling the temperature of the coolant 54, the coolant 54 of a desired temperature can be supplied to the cutting region 56. Therefore, even if the coolant 54 is used in circulation, it becomes possible to stabilize the life of the cutting blades 30 and the quality of the cut surface throughout the year.

If the heat resistant resin 36*b* is a phenol resin, good wettability of the resin enhances bonding with the base plate 34 made of a hard alloy, a high speed steel and so on, making possible to cut the magnet member 50 cleanly even under a high load. If the heat resistant resin 36*b* is a polyimide resin, heat resistance and mechanical strength can be increased, making possible to cut the magnet member 50 appropriately even under a high load in this case again.

Further, since the super hard abrasive grain is used as the abrasive grain 36*a*, chipping of the cutting edge 36 is reduced at the time of cutting, and when the exposed abrasive grain 36*a* has been worn, new abrasive grain 36*a* from underneath is already exposed, improving the quality of the cut surface.

Rotating speed (circumferential speed) of the cutting blades 30 is preferably 1000 m/min~3000 m/min. If the rotating speed of the cutting blades 30 is slower than 1000 m/min, the cutting time becomes too long, and the cutting blades 30 are deformed by idle rotation. On the other hand, if the speed exceeds 3000 m/min, an air flow accompanying the rotation prevents sufficient supply of the coolant 54 to the cutting region 56, causing seizure of the cutting blades 30.

Rate of volume of the abrasive grain 36*a* in the bonded layer of the abrasive grain, i.e. the cutting edge 36, is preferably 10%~50%. If the volume rate of the abrasive grain 36*a* is lower than 10%, the amount of the abrasive grain 36*a* is too small, and the cutting ability becomes extremely low. On the other hand, if the rate exceeds 50%, the abrasive grain 36*a* falls off too soon, decreasing the life of the cutting blades 30. A more preferable volume rate of the abrasive grain 36a in the cutting edge 36 is about 20%~25%.

Further, by including powder of a metal such as Fe, Cu and so on in the cutting edge 36, the heat resistance and strength of the cutting blades 30 can be improved. The inclusion of the metal powder improves thermal conductivity, making easier to control the temperature of the cutting edge 36, thereby preventing the cutting edge 36 from unnecessary wear.

The present invention is effective especially if the magnet member 50 is a material such as a sintered rare-earth magnet member disclosed in the U.S. Pat. Nos. 4,770,723 and 4,792,368, comprising a primary phase which is hard and a grain boundary phase which is tough. The sintered magnet member, which is high in fragility and hardness, is a hard-to-cut material with a high cutting load. However, according to the present invention, the abrasive grain 36a of the cutting blades 30 can be exposed more effectively. Therefore, the cutting load does not increase at the place of cutting of the magnet member 50 even if the blade thickness of the cutting blades 30 is small, making possible to cut with improved quality of the cut surface.

If the magnet member 50 is a sintered rare-earth magnet members, a piece of the rare-earth alloy obtained by cutting the magnet member 50 is first machine-polished to have smooth surfaces. Then, protective coating is provided for protection against oxidization, and then magnetized according to a known method into a rare-earth magnet. The rare-earth magnet thus obtained is suitably used as a material for a voice coil motor serving for positioning of a magnetic head. Alternatively of course, the rare-earth magnet may be obtained by cutting the magnet member 50 after magnetization.

The rare-earth magnet comprises an "R—T—(M)—B magnet", where R is a rare-earth element including Y, T is Fe or a Fe—Co compound, M is an additive and B is boron.

Now, an experiment in which the magnet member 50 is cut by using the magnet member cutting apparatus 10 will be described.

Conditions of the experiment is summarized in Table 1.

TABLE 1

| Cutting Conditions | |
|---|---|
| Cutting apparatus | Disc-blade type cutting apparatus<br>Cutting blade drive motor: 7.5 kW<br>Cantilever-type rotating axis |
| Cutting mode | X-feed cutting (indicated by arrow B in Fig. 2) |
| Cutting blade | Cutting edge: Resin-bound diamond grinding stone<br>Abrasive grain; Diamond (artificial)<br>Grain diameter; 200 μm–250/μm<br>Cu included in resin; (a few μm)<br>Binder; Resin (phenol, nonporous)<br>Concentration; 75 (18 vol %)<br>Base plate: Hard alloy<br>Dimensions:<br><br>Cutting blade outer diameter; 125 mm<br>Cutting edge thickness; 0.8 mm<br>Base plate thickness; 0.7 mm<br>Base blade inner diameter; 40 mm<br>Spacer:<br><br>Outer diameter; 65 mm<br>Thickness; 2.5 mm<br>Inner diameter; 40 mm<br>Three blades assembled in a block |
| Cutting blade circumferential speed | 2350 m/min (6000 rpm) |
| Cutting speed | 30 mm/min |
| Coolant | Discharge pressure: 3 kgf/cm$^2$–4 kgf/cm$^2$<br>Discharge volume: 20 l/min–30 l/min<br>Coolant temperature: 12° C., 25° C., 45° C.<br>Type of coolant: Chemical solution type<br>2% dilution |
| Work | Sintered rare-earth magnet member (R-Fe-B magnet member) for driving an optical pickup lens<br>Height of cutting: 25 mm (depth of cut)<br>Thickness of cutting: 2.8 mm<br>Two works cut per pass |

TABLE 1-continued

| Cutting Conditions | |
|---|---|
| Number of cutting cycles | 100 passes (200 works) |

As shown in Table 1, the experiment used the cutting edge 36 including an abrasive grain made of diamond (artificial), bound by a resin (phenol; nonporous), having a concentration of 75 (18 volume %). The base plate 34 was made of tungsten carbide, i.e. a hard alloy. The cutting edge 36 had a thickness of 0.8 mm, the base plate 34 had a thickness of 0.7 mm, with provision of a 0.05 mm clearance on each side of the base plate 34. Each of the cutting blades 30 has an outer diameter of 125 mm, with projection of 30 mm. The term projection herein refers to a projected length of the cutting blade 30 from an outer circumferential edge of the spacer 32 to an outer circumferential edge of the cutting edge 36.

The cutting blades 30 had a rotating speed (circumferential speed) of 2350 m/min, and the cutting speed was 30 mm/min. The coolant 54 was prepared for example, by diluting JP-0497N manufactured by Castrol Limited, to 2 wt % by water. The works were Neomax 44H, a sintered rare-earth magnet member manufactured by Sumitomo Special Metals Co., Ltd.

Figure 8:
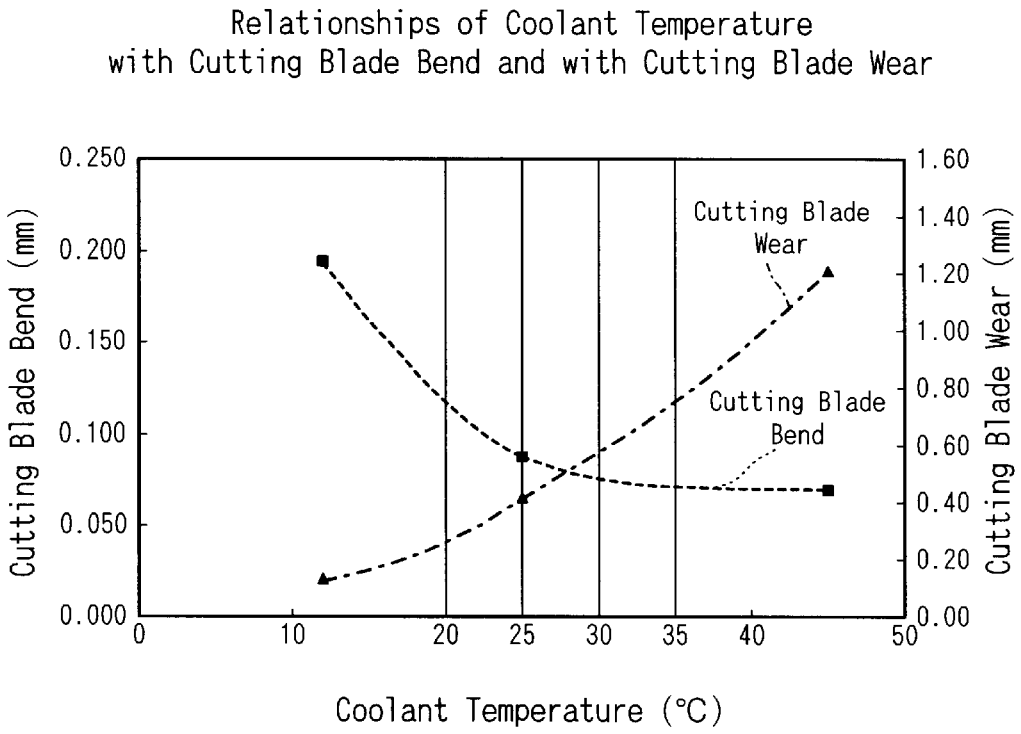
FIG. 8 is a graph showing relationships among the coolant temperature, the amount of bending of the cutting blade and an amount of wear of the cutting blade based on the result of the experiment in FIG. 7.
Figure 9:
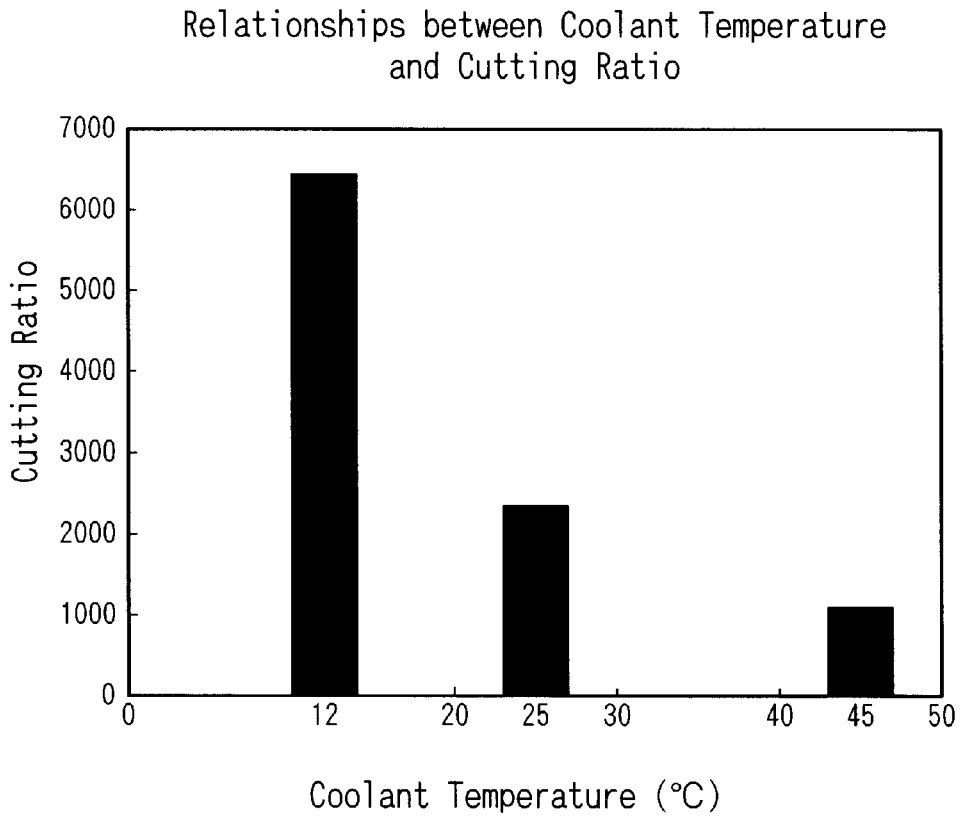
FIG. 9 is a graph showing relationships between the coolant temperature and a cutting ratio based on the result of the experiment in FIG. 7.
Figure 10:
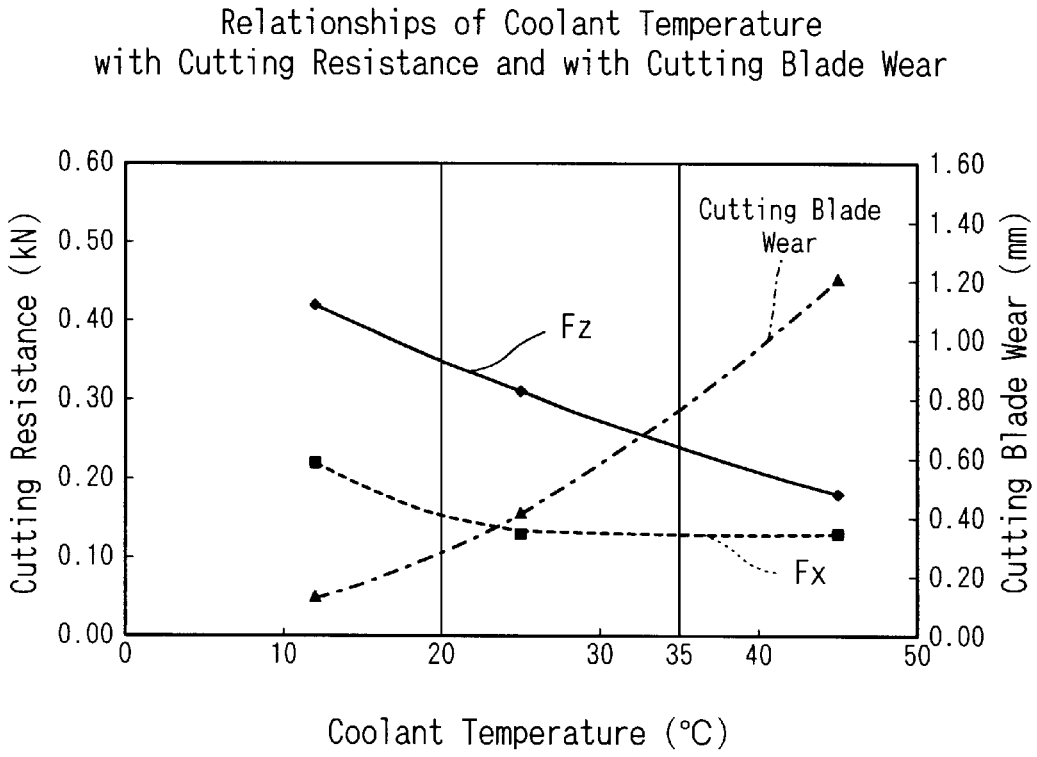
FIG. 10 is a graph showing relationships between the coolant temperature, cutting resistance (Fx, Fz) and the amount of wear of the cutting blade based on the result of the experiment in FIG. 7.

A result shown in FIG. 7 and graphs shown in FIGS. 8~10 are obtained from the experiment.

Figure 6:
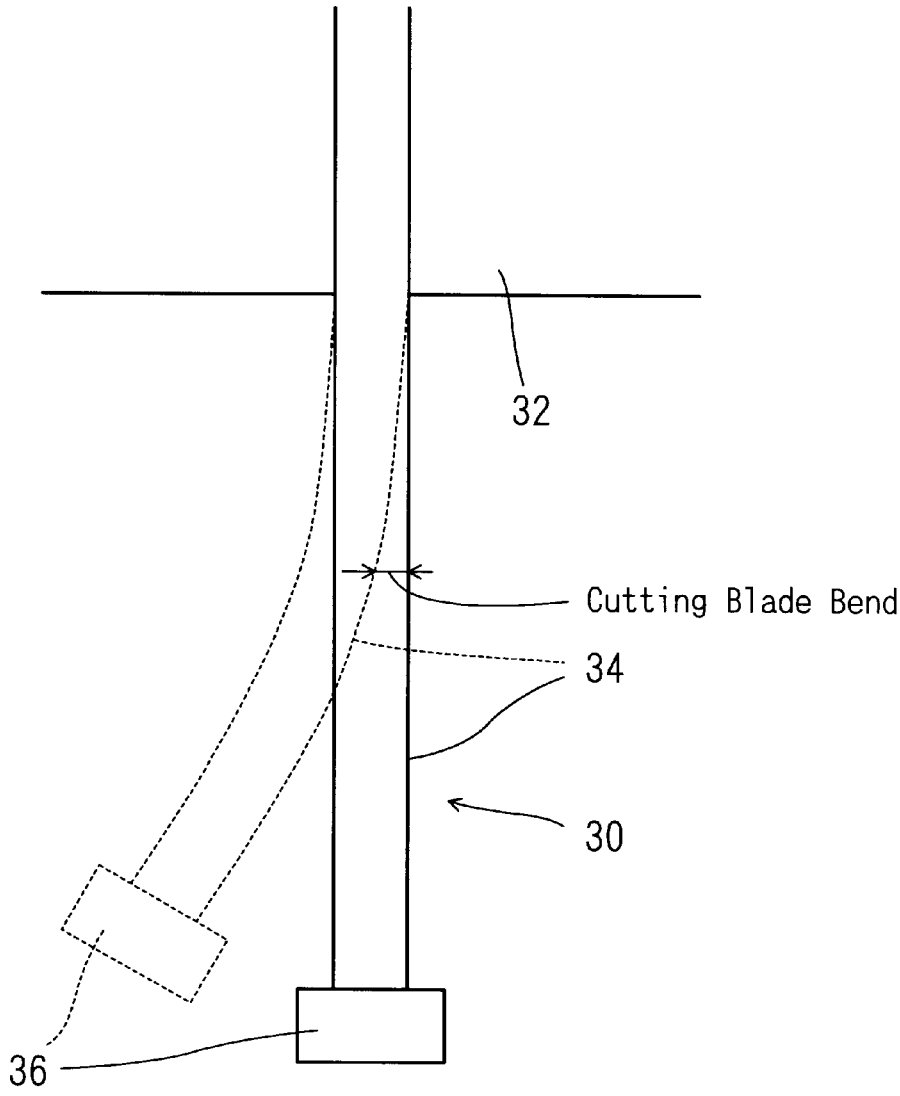
FIG. 6 is a diagram illustrating an amount of bending of the cutting blade.

The term "cutting blade bend" used herein is a value indicating an extent of deformation of the cutting blade 30 at the time of cutting, and is defined as shown in FIG. 6, as a distance of movement of a predetermined point of the base plate 34 between a "normal" state and a "deformed" state of the cutting blade 30. If "the cutting blade bend" is large, dimensional accuracy of a member obtained by the cutting is poor.

The term "cutting blade wear" is an amount of wear of the cutting edge 36 of the cutting blade 30.

The term "cutting ratio" is a value obtained by dividing an amount (volume) of cut off the magnet member 50 by the cutting blade wear (volume). A small "cutting ratio" indicates that the cutting blade 30 wears easily whereas a large "cutting ratio" indicates that the cutting blade 30 does not wear easily.

From FIG. 8 and FIG. 9, it is learned that if the temperature of the coolant 54 is low, the magnet member 50 is not cut easily and the quality of cut surface is poor, since the cutting ratio is large but the amount of cutting wear is small and the amount of cutting blade bending is large. On the other hand, if the temperature of the coolant 54 is high, the magnet member 50 is cut easily and the quality of cut surface is high, since the cutting blade wear is large and the cutting blade bend is small; however, the cutting blades 30 wear out quickly because the cutting ratio is low.

More specifically, as shown in FIG. 8, if the cutting blade bend exceeds 0.120 mm, i.e. if the temperature of the coolant 54 is below 20° C., dimensional inconsistency of the cut surface becomes too large, decreasing the yield of product. Further, if the temperature of the coolant 54 is below 20° C., the deflection of the cutting blades 30 becomes large as understood from FIG. 8, and the cutting resistance becomes large as shown in FIG. 10, decreasing the cutting accuracy. On the other hand, if the temperature of the coolant 54 exceeds 35° C., the cutting blade wear becomes large, decreasing the life of the cutting blades 30.

Therefore, the temperature of the coolant 54 is desirably 20° C.~35° C. In this case, the life of the cutting blades 30 can be increased, with the high quality of the cut surface. More preferably, the temperature of the coolant 54 should be 25° C.~30° C. In this case, the life of the cutting blades 30 can be increased further while the quality of the cut surface becomes higher.

In a cutting apparatus which uses a coolant in circulation for the sake of environmental protection, it is difficult to maintain the temperature of the coolant supplied to the cutting region at 20° C.~35° C. since friction heat is accumulated in the coolant. However, according to the magnet member cutting apparatus 10, by using the temperature controller 72, it has become possible to maintain the temperature of the coolant within this temperature range.

It should be noted here, that the present invention can not only be applied to the X-feed type magnet member cutting apparatus 10 but also to a magnet member cutting apparatus in which the magnet member 50 is cut by Z-feed.

The present invention being thus far described and illustrated in detail, it is obvious that these description and drawings only represent an example of the present invention, and should not be interpreted as limiting the invention. The spirit and scope of the present invention is only limited by words used in the accompanied claims.

What is claimed is:

1. A magnet member cutting method comprising:

a first step of preparing a cutting blade having a cutting edge including abrasive grain and heat resistant resin; and a second step of cutting a magnet member by the cutting blade while supplying temperature-controlled coolant to a cutting region.

2. The method according to claim 1, wherein the coolant is used in circulation.

3. The method according to claim 1, wherein the abrasive grain is a super hard abrasive grain.

4. The method according to claim 1, wherein the heat resistant resin is a phenol resin.

5. The method according to claim 4, wherein the temperature of the coolant is 20° C.~35° C.

6. The method according to claim 1, wherein the cutting blade is rotated at a speed of 1000 m/min~3000 m/min.

7. The method according to claim 1, wherein a volume rate of the abrasive grain to the cutting edge is 10%~50%.

8. The method according to claim 1, wherein the cutting edge further includes metal powder.

9. The method according to claim 1, wherein the magnet member is a sintered rare-earth magnet member.

10. A magnet member cutting apparatus comprising:

temperature controlling means for temperature control of a coolant;

coolant supplying means for supply of the coolant at a temperature controlled by the temperature controlling means to a cutting region; and cutting operation means for cutting a magnet member by using a cutting blade having a cutting edge including abrasive grain and heat resistant resin while the coolant is supplied by the coolant supplying means to the cutting region.

11. The apparatus according to claim 10, wherein the coolant supplying means includes means for supplying the cutting region with the coolant by circulating the coolant from the cutting operation means.

12. The apparatus according to claim 10, wherein the abrasive grain is a super hard abrasive grain.

13. The apparatus according to claim 10, wherein the heat resistant resin is a phenol resin.

14. The apparatus according to claim 13, wherein the temperature of the coolant is controlled to 20° C.~35° C. by the temperature controlling means.

15. The apparatus according to claim 10, wherein the cutting blade is rotated at a speed of 1000 m/min~3000 m/min.

16. The apparatus according to claim 10, wherein, a volume rate of the abrasive grain to the cutting edge is 10%~50%.

17. The apparatus according to claim 10, wherein the cutting edge further includes metal powder.

18. The apparatus according to claim 10, wherein the magnet member is a sintered rare-earth magnet member.

19. A magnet member cutting apparatus comprising:

a temperature controller for temperature control of a coolant;

a coolant supplying path for the coolant at a temperature controlled by the temperature controller;

a coolant discharging device for supply of the coolant from the coolant supplying path to a cutting region; and a cutting operation portion for cutting a magnet member by using a cutting blade having a cutting edge including abrasive grain and heat resistant resin while the coolant is supplied by the coolant discharging device to the cutting region.

20. A rare-earth magnet obtained by a magnet member cutting method comprising:

a first step of preparing a cutting blade having a cutting edge including abrasive grain and heat resistant resin; and a second step of cutting a magnet member by the cutting blade while supplying temperature-controlled coolant to a cutting region.

* * * * *

UNITED STATES PATENT AND TRADEMARK OFFICE

CERTIFICATE OF CORRECTION

PATENT NO. : 6,386,948 B1
DATED : May 14, 2002
INVENTOR(S) : Sadahiko Kondo

It is certified that error appears in the above-identified patent and that said Letters Patent is hereby corrected as shown below:

Title page, Item [54] and Column 1, lines 1-2,
The title should read as follows: -- MAGNET MEMBER CUTTING METHOD AND MAGNET MEMBER CUTTING APPARATUS --.

Title page,
Item [*], Notice, amend to read as follows:
-- [*] Notice: Subject to any disclaimer, the term of this patent is extended or adjusted under 35 U.S.C. 154(b) by 0 days. --

Column 8,
Line 40, "-250/$\mu$m" should be corrected so as to read as -- -250 $\mu$m --.

Signed and Sealed this

Thirteenth Day of May, 2003

JAMES E. ROGAN
*Director of the United States Patent and Trademark Office*